United States Patent [19]

Eckberg

[11] 4,272,703

[45] Jun. 9, 1981

[54] D.C. VOLTAGE FLUORESCENT LAMP

[75] Inventor: Edwin E. Eckberg, 5504 Currier Cir., Boise, Id. 83705

[73] Assignee: Edwin E. Eckberg, Boise, Id.

[21] Appl. No.: 48,991

[22] Filed: Jun. 15, 1979

[51] Int. Cl.[3] ..... H05B 41/22

[52] U.S. Cl. ..... 315/205; 313/197; 313/493; 315/51; 315/59; 315/335

[58] Field of Search ..... 315/205, 312, 324, 335, 315/DIG. 5, 51, 58, 59; 313/491, 493, 190, 198, 220, 197

[56] References Cited

U.S. PATENT DOCUMENTS

| | | | |
|---|---|---|---|
| 3,194,997 | 7/1965 | Waly | 313/190 X |
| 3,666,986 | 5/1972 | Lake | 313/198 X |
| 4,010,398 | 3/1977 | Meuwes | 315/205 X |
| 4,158,153 | 6/1979 | Eckberg | 313/491 |

*Primary Examiner*—Eugene R. LaRoche
*Attorney, Agent, or Firm*—Robert F. O'Connell

[57] ABSTRACT

A fluorescent lamp having a plurality of columns positioned in a generally uniform manner within the lamp envelope, each column having an electron emissive cathode mounted therein connected to a cathode leadwire. An anode member connected to an anode leadwire extends to the upper portions of each column. A conductive starter member is mounted within each column so as to provide a first gap between one of its ends and the cathode and a second gap between the other of its ends and the associated anode extension. A D.C. voltage is applied to the anode and cathode leadwires, the D.C. voltage being obtainable from an external A.C. source via a suitable voltage rectifier/multiplier circuit which is positioned within the re-entrant stem member of the lamp.

24 Claims, 7 Drawing Figures

D.C. VOLTAGE FLUORESCENT LAMP

INTRODUCTION

This invention relates generally to fluorescent light sources and, more particularly, to fluorescent light bulbs which use alternating current applied as the input, but which use direct current internally to provide an ionic gas and mercury vapor discharge operation.

BACKGROUND OF THE INVENTION

Low voltage gas discharge lamps using a thermal type of hot cathode, and requiring a ballast, are known to the art. Such lamps rely upon an elevated temperature of the cathode for electron emission and normally require relatively high starting voltages. Such lamps have life expectancies at best of about 2000 hours.

Improvement in life expectancy can be anticipated using cool, or cold, cathodes wherein electron emission is a chemical at moderately low temperatures.

A very recently proposed low voltage, cold cathode fluorescent lamp using externally applied alternating current and having internal electrode structures using alternating current is described in my copending U.S. patent Application, Ser. No. 871,605, filed Jan. 23, 1978, now U.S. Pat. No. 4,158,153. Such lamps must normally be operated using a 220 volt, 60 cycle A-C input voltage and cannot be readily manufactured for use with standard 110 volt, 60 cycle A-C input voltage as found in operating incandescent lamps in the home. Moreover, the efficiency of such operation, as in the multi-column structures described in my above-mentioned application, is less than desired since each column only operates during one-half of each A.C. voltage cycle and the light output as a function of input power is not as high as could be desired, even though life expectancy is improved over previously suggested lamps of that type.

It is desirable to design a fluorescent lamp which can operate at A.C. input voltages of 110 volts, 60 cycles, for example, using cold cathodes, and which can achieve high efficiency (lumen output per watt input) and long life (e.g. well over 10,000 hours of effective operation).

BRIEF SUMMARY OF THE INVENTION

The invention comprises a low voltage fluorescent lamp which utilizes an internal direct current ionic discharge which can be energized by externally applied alternating current. In use the lamp is arranged for insertion into any standard screw type socket providing 110 volts to 120 volts, alternating current single phase voltage and requires no ballast. The direct current is provided by a self-contained, solid-state, rectified voltage multiplier circuit which supplies a full-wave rectified D.C. voltage output. The input to the multiplier is connected to the screw base of the bulb. Suitable current control is provided on the D.C. output side of the voltage multiplier which then leads directly to the feedthrough leadwires of the lamp's internal structure, or mount.

The envelope of the lamp is coated on its inner surface with a suitable phosphor which is rendered visible and uniformly fluorescent by both the strong ultra violet component, e.g. at a wavelength λ equal to about 2537 ÅU, and the visible blue mercury discharge component that radiate from a plurality of clear hollow quartz (or equivalent) source tubes contained in the lamp. These source tubes are of the uniformly restricted positive column ionic gas and mercury vapor discharge type and are positioned symetrically on a ceramic platform within the lamp envelope.

The glass stem of the lamp together with the feedthrough leadwires therein is of the re-entrance type and presents a convenient hollow space, at atmospheric temperature and pressure, directly below the feedthrough leadwires. This space is used to contain the solid state voltage multiplier and current control components. Each of the ultra violet quartz source tubes contains its respective cathode positioned just above the platform, each cathode being connected with one of the several feedthrough leadwires which pass through the platform. All cathodes are coated on their inner surfaces with an electron emissive material comprising a suitable semiconductive preactivated chemical. One additional feedthrough leadwire, centrally located and leading upward through the platform, is connected to a common anode for all of the positive column discharge tubes. The common anode may be in the form of a metallic disc member or, preferably, a spoked arrangement, each of the spokes of which leads to the top edge of each source tube.

A conductive starting member is positioned in each of the source tubes and is electrically separated from both its respective cathode and anode by two narrow gaps. The starting member may take the form of a relative fine wire or a narrow thin metal ribbon and is considered as an electrically floating member. The feedthrough leadwires of all cathodes are connected together in parallel and are in turn connected to the negative side of the voltage multiplier. The anodic feedthrough leadwire connects to one side of a current control circuit which then connects with the positive side of the voltage multiplier circuit.

This new low voltage, fluorescent light lamp of the invention should have a life expectancy upward of 25,000 hours while providing satisfactory lumen output. Further, no radio or television interference is caused by the use of such lamp.

DESCRIPTION OF THE DRAWINGS

The invention can be described in more detail with the help of the accompanying drawings wherein:

As seen in FIGS. 1-4, a preferred embodiment of the direct current discharge fluorescent low voltage lamp of the invention comprises a right cylindrical tubular glass envelope 1 having a well formed and closed top 2. The entire inner surface of envelope 1,2 is uniformly coated with a suitable phosphor material 3. This material is preselected in order to furnish the desired visible color of light output, or fluorescence, as is known to the art. A glass re-entrance stem 4 has suitable glass beading 5 fused to a plurality of feedthrough leadwires 6 which are properly positioned and sealed through the top closed end of stem member 4. A slight flaring of the bottom open end of the stem member 4 is provided to facilitate the later sealing of stem 4 to envelope 1 during fabrication. A ceramic disc platform member 7 having a plurality of through holes 8 and corresponding boss members 9 concentric thereto is positioned within the lamp.

A plurality of corresponding source tubes 13 are fitted over each respective boss member 9 and attached thereto with the use of either solder-glass or cement 14.

Figure 1:
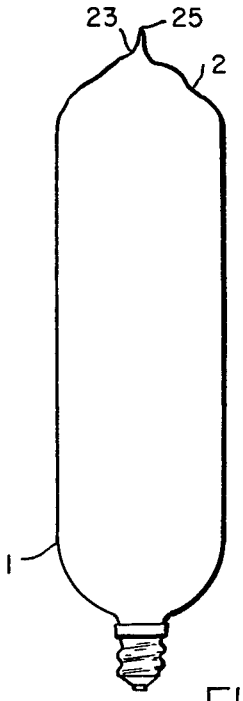
FIG. 1 shows an external side view of the lamp of the invention.
Figure 3:
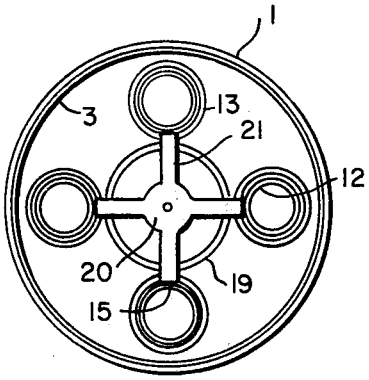
FIG. 3 shows a plan view looking downwardly from the top of the lamp portion along the direction of line 3—3 of FIG. 2.

Cathodes 10 are provided at the bottom of each source tube, each cathode being spotwelded at 11 to the ends of feedthrough leadwires 6. An electron emissive coating material 12 is uniformly applied to the inner surfaces of all cathode members 10 (FIG. 3). Clear fused quartz, or its equivalent with respect to the transmission of both visible and ultra violet, is used to provide source tubes 13. Such tubes are of uniform bore, have relatively thin walls, and are squarely cut at each end to a uniform length (or height).

Figure 7:
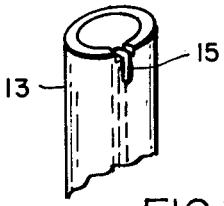
FIG. 7 shows a detailed view of a portion of the lamp of FIGS. 2 and 3.
Figure 2:
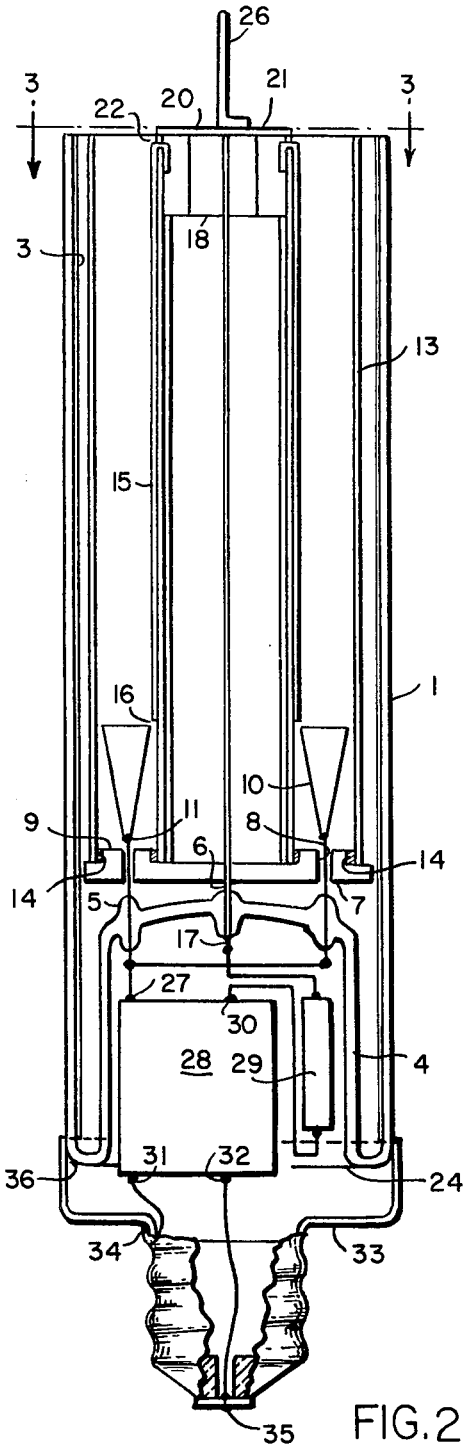
FIG. 2 shows a cut-away side view of the interior portion of the lamp of FIG. 1.
Figure 4:
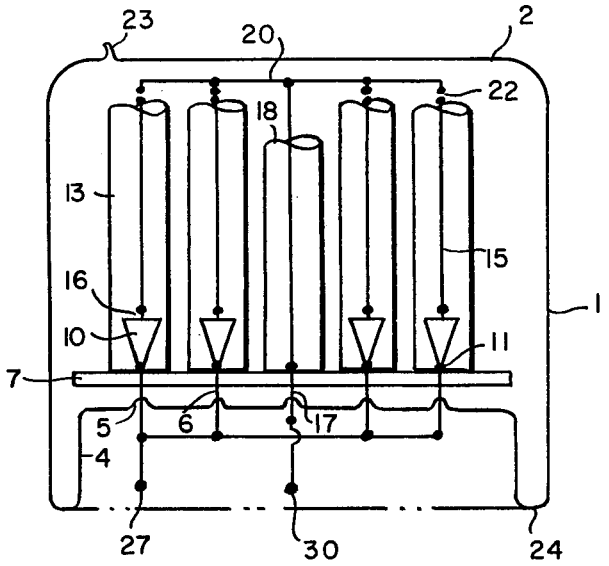
FIG. 4 shows an unfolded diagrammatic view of the interior portion of the lamp of FIGS. 2 and 3.

Each of the source tube members 13 is provided with a conductive starter member 15 which may be cemented to the inner vertical sidewall of each of the source tube members 13 or may be attached to its respective cathode member 10 via an electrically insulating member. In either case, an insulative gap 16 is provided between the upper part of cathode 10 and the lower end of the conductive starter 15. The width of gap 16 should preferably be within a range from about 0.50 millimeters to about 3.50 millimeters and preferably should be about, and not exceed, 0.75 millimeters. Insulative gap 16 acts as the lower gap member for each starter 15. The conductive starter members extend upwardly to within about 0.50 millimeters to about 3.50 millimeters, and preferably to within about 0.75 millimeters, of the open tops of each source tube members 13, as shown in FIG. 7.

A single beaded feedthrough leadwire 17 is provided at the center of the glass re-entrance stem 4 and extends vertically up to a level with the top, open-cut ends of the source tube members 13. The centralized leadwire 17 passes upwardly through a spacer tube member 18 which has a length (height) approximately 1 centimeter less than that of the source tubes 13. The spacer tube member 18 may also be of fused quartz, or its equivalent. If a softer glass is used for the spacer member, e.g., a glass material non-transmissive to ultra-violet, then its exterior surface must be provided with a reflective material. One suitable thin-film for this purpose can be pure aluminum. Another effective material is the phosphor coating. A common anode member 20 having spoke-like extensions 21 is provided at the top of the lamp and is attached to the central feedthrough leadwire 17 as shown. The spokes or extensions 21 of the common anode 20 are flat and form a second, or top, gap 22 with the upper ends of starter members 15 at the top of each of the source tube members 13. This upper gap 22, as mentioned above, also preferably has a separation, or spacing, of about, and preferably not exceeding, 0.75 millimeter with reference to the top end of starter 15.

A tubulation member 23 is fused to the top member 2 of the envelope at its center and is later used for the processing of the lamp. The flared or enlarged lower edge of re-entrance stem member 4 is fused and sealed to the lower open envelope member 2 and forms the main seal of the lamp at 24.

When the components discussed above are assembled the lamp processing can be carried out as follows. Such processing involves the purification and thorough evacuation of the lamp. When an inactivated electron emissive cathode coating 12 is to be used, high internal discharge currents are required to convert the coating material and render it activated. Such activation also can be accomplished by the use of external high frequency bombardments, or by induction heating techniques, as would be known to the art. Preferably, a preconverted, preactivated electron emissive coating material 12 is used, which material does not require excessive currents to be used.

The processing cycle is completed with the final injection of a small globule of pure fluid mercury into the lamp, as well as a relatively low pressure of an inert rare gas, such as argon, as is well known to the art. After such materials are injected into the lamp, a final seal-off, or tip-off, is performed and provides the tip-off point 25. While four source tubes 13 are shown in the embodiment shown, a larger number can be used to provide higher lumen output. In the event that more than four source discharge tubes are to be incorporated in the lamp, it is advisable to provide an additional supporting member 26 to stabilize the internal assembled structure. Member 26 may take the form of an extension from the top of the common anode member 20 which extends a small distance into the tubulation member 23. Either a glass rod or a medium size firm wire, for example, can be used for extension member 26 which is integrally formed in anode 20 or formed separately and suitably attached thereto.

Following the processing and final tip-offs, it is a general practice in the art to test check the lamp for its output characteristics and, when found acceptable, the following electrical connections and base attachment are carried out to complete the lamp. The lower ends of feedthrough leadwires 6 are joined together and connected to the negative terminal 27 of voltage rectifier/-multiplier circuit 28. The single anodic feedthrough leadwire 17 is connected to current control member 29 in series with the positive terminal 30 of rectifier/multiplier 28. The rectifier/multiplier member 28 provides a D.C. voltage across terminals 30 and 27 and has additional input terminals 31 and 32, respectively, for the A.C. voltage at the input to the circuit. An adapter member 33, having a screw type base as an integral part, is cemented to the lamp at its main seal location 24, with a suitable basing compound 36. The screw type base portion of adapter 33 has two separate, electrically conductive sides which are connected to members 31 and 32, respectively, via solder connections 34 and 35, respectively, as shown to provide connections to the input terminals of the voltage multiplier circuit.

A preferred form of the emissive coating which is used in the invention is that which is equivalent to a stable, non-hygroscopic, and semi-conductor preactivated emissive coating of the type disclosed, for example, in U.S. Pat. No. 2,911,376, issued on Nov. 3, 1959 to J. Rudolph. Such coating appears to be superior to the conventional emissive coatings which are still commonly used, e.g., the oxides of rare earth metals, namely barium, strontium, and calcium which oxides in standard practice are obtained by suitable conversion of the respective carbonates thereof. Such conversion is, however, seldom thorough and complete, so that spotting and sputtering from such coating result after a few thousand hours of operation, if the voltage drop, as a cold cathode, is approximately between 85 to 95 volts. The Rudolph type of emissive coating is a doped barium cerate with a fluorine additive which comprises less than 0.05% gram-mols of the whole. The fabrication of such a coating material is adequately described in the above-referenced Rudolph patent, as would be understood by those in the art.

The ultraviolet transmissive source tubes of the invention can be made of fused silica (quartz), or its equivalent. One exemplary equivalent is made by Corning Glass Works under the description CODE #9741, which equivalent is less costly than quartz.

The metal which is found to be most satisfactory for cathode fabrication, especially in gas and mercury filled discharge devices, is iron. Also a nickel-iron alloy or a nickel-clad iron can alternatively be used. When iron is used, it is advisable to provide it with a "quick copper plating" prior to application of the emissive coating. Such plating has been found to be especially effective when the rare earth oxides mentioned above are used as the emissive coating. The starter members and the common anode assembly may likewise be of one or the other of the metals discussed above for cathode fabrication. The feedthrough leadwires can all be of the borated copper-clad type, or Dumet. The use of Dumet is particularly applicable when using soft grades of glass. If borosilica is used, a tungsten lead must be sealed through the hard glass and nickel, or iron, extensions may be butt welded thereto to form the entire leadwire. Other alternate materials would also be known to the art for such purposes. For example, an alloy made by Sylvania Electric under the description No. 4 alloy can also be used for the softer glasses, while a suitable kovar-metal alloy can be used for the harder grades of glass.

Glass grades which can be used in the present invention include a soft soda-lime glass, having a relatively thin wall (e.g. Corning's CODE 0080) for the envelope member. The stem glass can be of Corning's CODE 0012, while the beading preferably can be Corning's CODE 0010.

For the platform member in the invention, a ceramic known to the art as Steatite, can be used, such material being made and sold under such description by Isolantite Manufacturing Corporation
Warren Avenue
Stirling, N.J. 07980.

The adapter member, inclusive of the screw-type base, can be of spun metal, such as aluminum. Insulation is required and it is found that a plastic adapter designed to receive the metal screw-type base is satisfactory. The size of the screw-type base is generally known to the art as the Edison size, a medium-sized base which is relatively standard in most homes and offices for screw-type socket equipment. Likewise, this rule also applies to the fuse.

The phosphor coating is of the type used in standard practice for such lamps. When a bakable type of phosphor material is used, it is necessary that a small percentage of oxygen be added to the air stream which is used to dry the coating and during bakeout. The latter, for soft glass and 3500° K. WHITE phosphor normally calls for a temperature of 590° C. for bakeout. Such operation is carried out prior to the final seal-in of the lamp (i.e., the seal-in of the mount assembly and envelope) as is known to the art.

Purification, required conversions, if any, and thorough evacuation of gas discharge tubes use procedures well known to the art. Since the ultimate pressure that the vacuum system is able to attain will result directly in a measurable molecular population, e.g. spurious residual gas molecules, the presence thereof in turn will effect the final purity and, therefore, the operation and characteristics of the product being processed. To attain the lowest possible ultra-high and ultra-dry vacuum, prior to gas fill and seal-off, in the order of $10^{-9}$ Torr or as low as $10^{-10}$ Torr, the desired low pressures have been positively and reliably produced using a true molecular high vacuum pump in the vacuum system. With such a pump no low temperature trapping is required. Specifically, one type of molecular vacuum pump which can be used is disclosed in United Kingdom Pat. No. 332,879 issued July 31, 1931 issued to Seigbahn. Another pump, known as the Unified System Vacuum Pump, as described in U.S. Pat. No. 3,104,802, issued Sept. 24, 1963 to E. E. Eckberg can also be used. The latter pump is the equivalent of several Seigbahn units integrated into a single fast and effective ultra-high vacuum pump (using mechanical, direct drive) and produces generally excellent results. The use of such pumps has precluded the necessity of any aging processes usually needed to get the processed unit up to a state of spectroscopic purity.

The vacuum system may be of either glass or metal, but in either case it should preferably be a bakable unit system, glass being preferred since its state of cleanliness can be seen at once. Also, if a leak appears, it can be located very promptly. The advantage of a metal system lies in its mechanical strength as compared to that of the glass which may be offset by the time consumed in using a leak detector to locate an essentially invisible leak.

The low voltage fluorescent lamp of the invention should provide a light source having a life of about 20 or more times that of the average filament type of light source. The gain in efficiency thereof is such that only about one-third the energy is required to produce a luminous output equivalent to that of the filament type of lamp. While the invention is primarily useful for ordinary "white" light, several other colors are available, including three or four, or more, shades of various white phosphors, the 3500° K. White phosphor appearing to be the most effective and efficient with respect to lumens-per-watt output. However, other colors available are: green, blue, red, and rose-tint, green and the red, for example, finding use in traffic signal systems.

Figure 5:
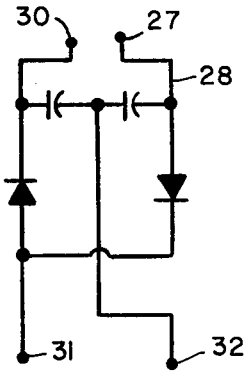
FIGS. 5 and 6 show circuit diagrams of two embodiments of the voltage multiplier used in the lamp of the invention.
Figure 6:
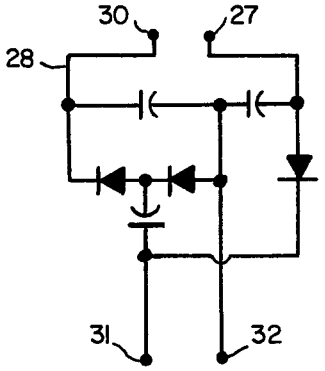

Circuitry for the voltage multiplier is depicted in FIGS. 5 and 6 for a voltage doubler and voltage tripler, respectively. The approximate voltage output V can be expressed as follows:

$$V = \frac{KE_p}{1 + 1/R_L fC}$$

where

E is the peak A.C. input voltage (in volts)
C is the capacitance of each of the capacitors shown (in farads)
$R_L$ is the load resistance (in ohms)
f is the A.C. frequency (in Hertz)
K is a constant equal to 2 for the doubler and 3 for the tripler.

While the above described embodiment represents a preferred embodiment of the invention, modifications thereof will occur to those in the art within the spirit and scope of the invention. Accordingly, the invention is not to be construed as limited thereto except as defined by the appended claims.

What is claimed is:

1. A fluorescent lamp comprising
an envelope having a phosphor coated inner surface;
a plurality of cathode leadwires supporting a platform member;
a plurality of column means mounted on said platform member;
electron emissive cathode means mounted within each column means, each said cathode means being connected to a cathode leadwire;
an anode member having extensions mounted adjacent the upper portions of each of said column means;
an anode leadwire connected to said anode member;
a conductive starter member mounted within each of said column means so as to provide a first insulative gap between one end of said starter member and its associated cathode means and a second insulative gap between the other end of said starter member and its associated anode extension; and
means for applying a D.C. voltage to said anode leadwire and each of said cathode leadwires.

2. A fluorescent lamp in accordance with claim 1 where said conductive starter member is a strip of metal mounted on the inner surface of each of said column means.

3. A fluorescent lamp in accordance with claims 1 or 2 wherein said first insulative gap lies within a range from about 0.75 millimeters to about 3.50 millimeters.

4. A fluorescent lamp in accordance with claim 3 wherein said first insulative gap is about 0.75 millimeters, to 3.50 millimeters.

5. A fluorescent lamp in accordance with claim 4 wherein said second insulative gap lies within a range from about 0.75 millimeters to about 1.00 millimeters, as a maximum.

6. A fluorescent lamp in accordance with claim 4 and further including
a spacer member mounted on said platform member, said plurality of column means arranged symmetrically about the exterior of said spacer member.

7. A fluorescent lamp in accordance with claim 4 wherein said D.C. voltage supplying means includes
voltage multiplier means responsive to an input A.C. voltage having a first voltage level for producing a multiplied D.C. voltage having a second voltage level for supply to said anode and cathode leadwires.

8. A fluorescent lamp in accordance with claims 1 or 2, wherein said second insulative gap lies within a range from about 0.75 millimeters to about 1.00 millimeters, as a maximum.

9. A fluorescent lamp in accordance with claim 5 wherein said second insulative gap is about 0.75 millimeters.

10. A fluorescent lamp in accordance with claim 6 and further including
a spacer member mounted on said platform member, said plurality of column means arranged symmetrically about the exterior of said spacer member.

11. A fluorescent lamp in accordance with claim 9 wherein said D.C. voltage supplying means includes
voltage multiplier means responsive to an input A.C. voltage having a first voltage level for producing a multiplied D.C. voltage having a second voltage level for supply to said anode and cathode leadwires.

12. A fluorescent lamp in accordance with claim 9 wherein said envelope includes a re-entrant stem member at one end thereof, said voltage multiplier means being mounted within said re-entrant stem member.

13. A fluorescent lamp in accordance with claims 1 or 2, and further including
a spacer member mounted on said platform member, said plurality of column means arranged symmetrically about the exterior of said spacer member.

14. A fluorescent lamp in accordance with claim 7 wherein said spacer member is a columnar means, said anode leadwire extending through said columnar means from said voltage supplying means to said anode member.

15. A fluorescent lamp in accordance with claim 8 wherein the exterior surface of said columnar spacer member is reflective.

16. A fluorescent lamp in accordance with claim 14 wherein said D.C. voltage supplying means includes
voltage multiplier means responsive to an input A.C. voltage having a first voltage level for producing a multiplied D.C. voltage having a second voltage level for supply to said anode and cathode leadwires.

17. A fluorescent lamp in accordance with claim 14 wherein said envelope includes a re-entrant stem member at one end thereof, said voltage multiplier means being mounted within said re-entrant stem member.

18. A fluorescent lamp in accordance with claim 14 wherein said envelope includes a re-entrant stem member at one end thereof, said voltage multiplier means being mounted within said re-entrant stem member.

19. A fluorescent lamp in accordance with claims 1 or 2, wherein said D.C. voltage supplying means includes
voltage multiplier means responsive to an input A.C. voltage having a first voltage level for producing a multiplied D.C. voltage having a second voltage level for supply to said anode and cathode leadwires.

20. A fluorescent lamp in accordance with claim 19 wherein said envelope includes a re-entrant stem member at one end thereof, said voltage multiplier means being mounted within said re-entrant stem member.

21. A fluorescent lamp in accordance with claims 1 or 2, wherein said envelope includes a re-entrant stem member at one end thereof, said voltage multiplier means being mounted within said re-entrant stem member.

22. A fluorescent lamp in accordance with claim 21 and further including
a base member attached to said re-entrant stem member for coupling to an input A.C. voltage source.

23. A fluorescent lamp in accordance with claim 22 wherein said base member is a screw type member capable of coupling to a corresponding screw type receptor element for connection to said input A.C. voltage source.

24. A fluorescent lamp in accordance with claim 1 and further including a stabilizer element attached to said anode member and extending to the upper region of said envelope.

* * * * *